United States Patent [19]

Cormault et al.

[11] 3,936,648

[45] Feb. 3, 1976

[54] FLAME MONITORING APPARATUS

[75] Inventors: Pierre J. B. Cormault, Fourqueux; Jean M. Megnoux, Poissy, both of France

[73] Assignee: Electricite de France, Paris, France

[22] Filed: Mar. 18, 1974

[21] Appl. No.: 452,449

[30] Foreign Application Priority Data

Mar. 20, 1973 France ..... 73.09936
Mar. 8, 1974 France ..... 74.07933

[52] U.S. Cl. ..... 250/554; 250/206; 340/228.2; 431/79

[51] Int. Cl.[2] ..... G01N 21/58

[58] Field of Search ..... 250/206, 214 R, 554; 340/228.2, 227 R; 431/79; 328/6

[56] References Cited

UNITED STATES PATENTS 2,794,974 6/1957 Bagno et al. ..... 340/228.2 X
3,613,062 10/1971 Bloice ..... 250/206 X
3,742,474 6/1973 Muller ..... 340/228.2
3,820,097 6/1974 Larson ..... 340/228.2

*Primary Examiner*—Walter Stolwein
*Attorney, Agent, or Firm*—Karl W. Flocks

[57] ABSTRACT

A filter having a cut-off frequency of the order of 50Hz is included in the circuit of flame monitoring apparatus to remove signals below the cut-off frequency. In the circuit shown, a silicon p-n junction photoelectric pick-up is capacitively connected to an amplifier, the amplifier is connected to a high-pass filter, the output of the filter is connected to a further amplifier, the output of the further amplifier is applied to a detector integrator, the output of the detector integrator is connected to a Schmitt trigger, and the output of the trigger is applied to an output circuit giving a warning signal if the flame being monitored is extinguished. The use of sighting tubes for the photoelectric pick-ups is disclosed.

11 Claims, 8 Drawing Figures

FLAME MONITORING APPARATUS

The present invention relates to flame monitoring apparatus.

Flame monitoring apparatus is used to determine whether or not the flame of a burner is alight and is particularly important for burners of high thermal power.

It has already been proposed to monitor burner flames by means of photo-electric cells and in particular photo-voltaic cells, by observing that the flame of a burner is flickering, that is, that the turbulences occurring in a burner flame make the brightness of it vary constantly. It has also been proposed, for example in the German Patent Application laid open to public inspection: DAS No. 1,092,594, to eliminate the continuous component of the current leaving the cell so as to retain only the alternating component which is then rectified to provide a signal indicating that the burner is alight.

Thus, when the burner is extinguished, the various heated bodies which are still radiant induce only continuous components in the cell and which are eliminated so that the device no longer supplies a signal.

Experience has shown, however, that when a burner is extinguished, the energy received by the cell is not strictly uniform and that alternating components are still present.

These alternating components when detected can lead to the false assumption that the burner is still operating.

The present invention provides flame monitoring apparatus comprising wide frequency band photo-electric pick-up means to receive luminous radiation from a flame being monitored, amplifying means coupled to the output of the photo-electric pick-up means, and an output circuit responsive to the output of the amplifying means to provide an indication of whether or not the flame is alight, wherein the amplifying means includes a filter having a cut-off frequency of the order of 50 Hertz to prevent signals below the cut-off frequency reaching the output circuit.

The Applicants have discovered that the radiation issued from a blast burner in a hot furnace has practically no physical phenomena at frequencies exceeding 50 Hz, but that when the burner is normally alight an appreciable quantity of energy is emitted with frequencies exceeding this figure.

In an embodiment of the invention to be described with reference to the drawings the radiation of a burner is directed to a photo-electric pick-up connected to a circuit including a high-pass filter with a cut-off frequency of approximately 50 Hz, the output signal of this filter being applied to a detector integrator, the output of which controls a trigger, connected to a device indicating the absence or the presence of a flame.

The photo-electric pick-up is a photo-voltaic cell responsive over a wide spectral band, so that accidental partial concealments, if they influence the amplitude of the signal received, do not alter the frequencies transmitted. As described, the cell is a silicon cell comprising a p-n junction.

The high-pass filter preferred is a filter having a CHEBYSHEV or BUTTERWORTH transfer function of the type $1/P(jw)$, the polynomial $P(jw)$ having $n$ roots (where $n$ is an integer), that is the transfer function has $n$ poles.

It is known that the greater $n$ is, the greater is the cut-off slope of the filter. Preferably the filter selected has a transfer function of the form $$G(jw) = \frac{N(jw)}{P(jw)}$$

which makes it possible to obtain virtually maximum cut-off slopes.

Such a filter, which involves the interaction of elliptical functions of the first and second kind, is usually called an "elliptical filter".

The described embodiment concerns the case of a combustion chamber fitted with a plurality of parallel-directed burners; it is known that in this case the flames of different burners tend to blend into one flame and it is particularly difficult to tell when one or several burners situated towards the centre of the group of burners are alight or not. In the embodiment, each burner is provided with an observation tube comprising near its outer end a photo-electric pick-up, this tube being arranged to form a small angle to meet the burner axis in the region of the maximum luminosity of the corresponding flame without meeting the axes of the other burners.

In effect the sighting tube essentially observes the flame towards which it is directed, and it is not directly influenced by the adjacent flames. The flickering of the reflection of these adjacent flames or that which comes from the solid walls lit up by the burner flames still operating, has a frequency much lower than the flickering coming from the axis of the flame directly observed, at the heart of which the luminous efflux has its maximum turbulence.

Consequently, if the cell receives other pulsed illumination when the flame it surveys has been extinguished, the current pulsation contains practically no components of frequency higher than 50 Hz.

By way of example only, an illustrative embodiment of the invention will now be described with reference to the accompanying drawings, in which.

Figure 3:
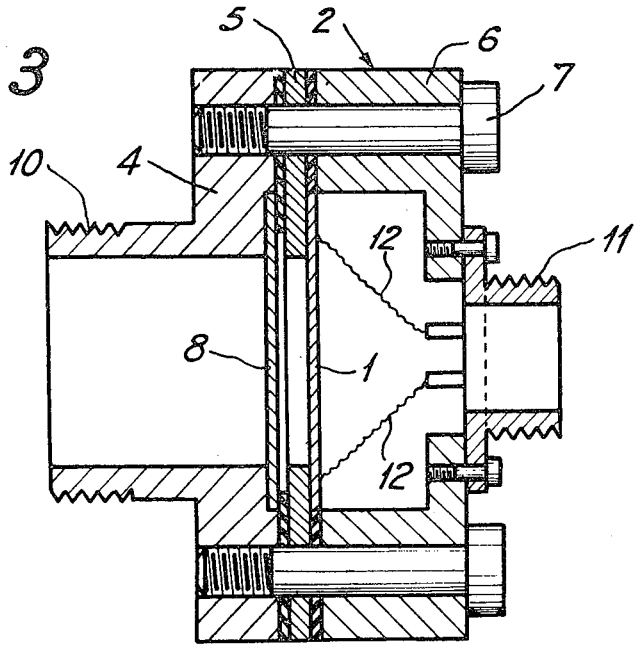
Figure 4:
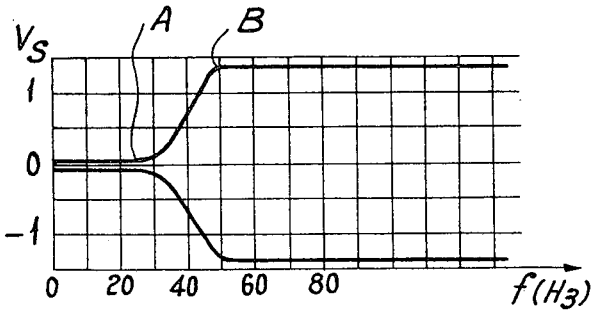
Figure 5:
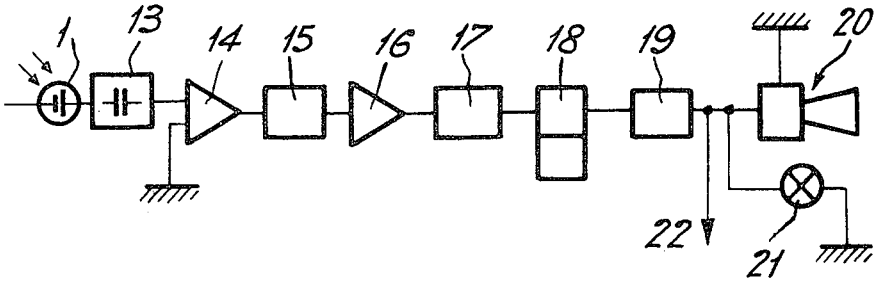
Figure 7:
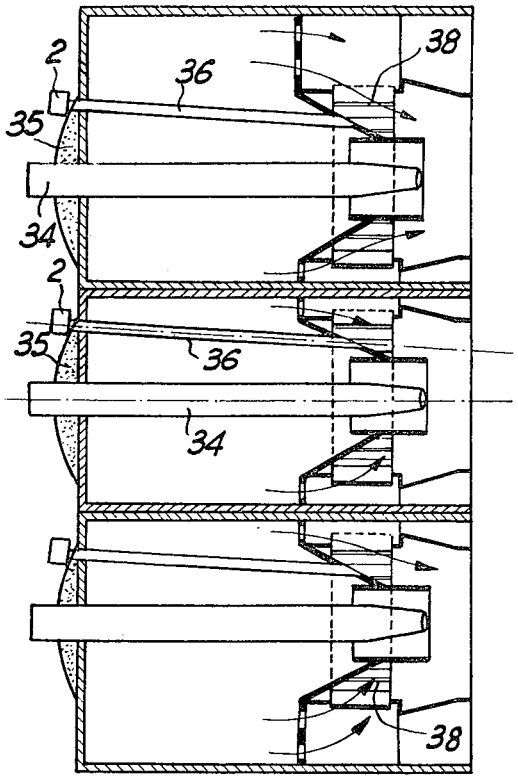
Figure 6:
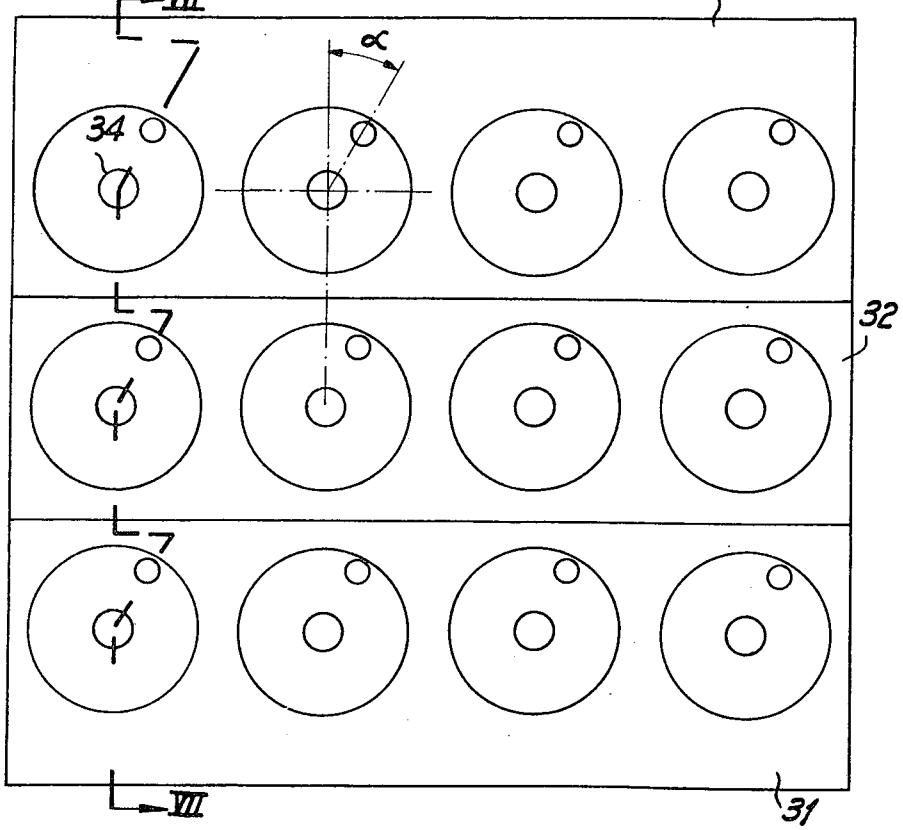
Figure 8:
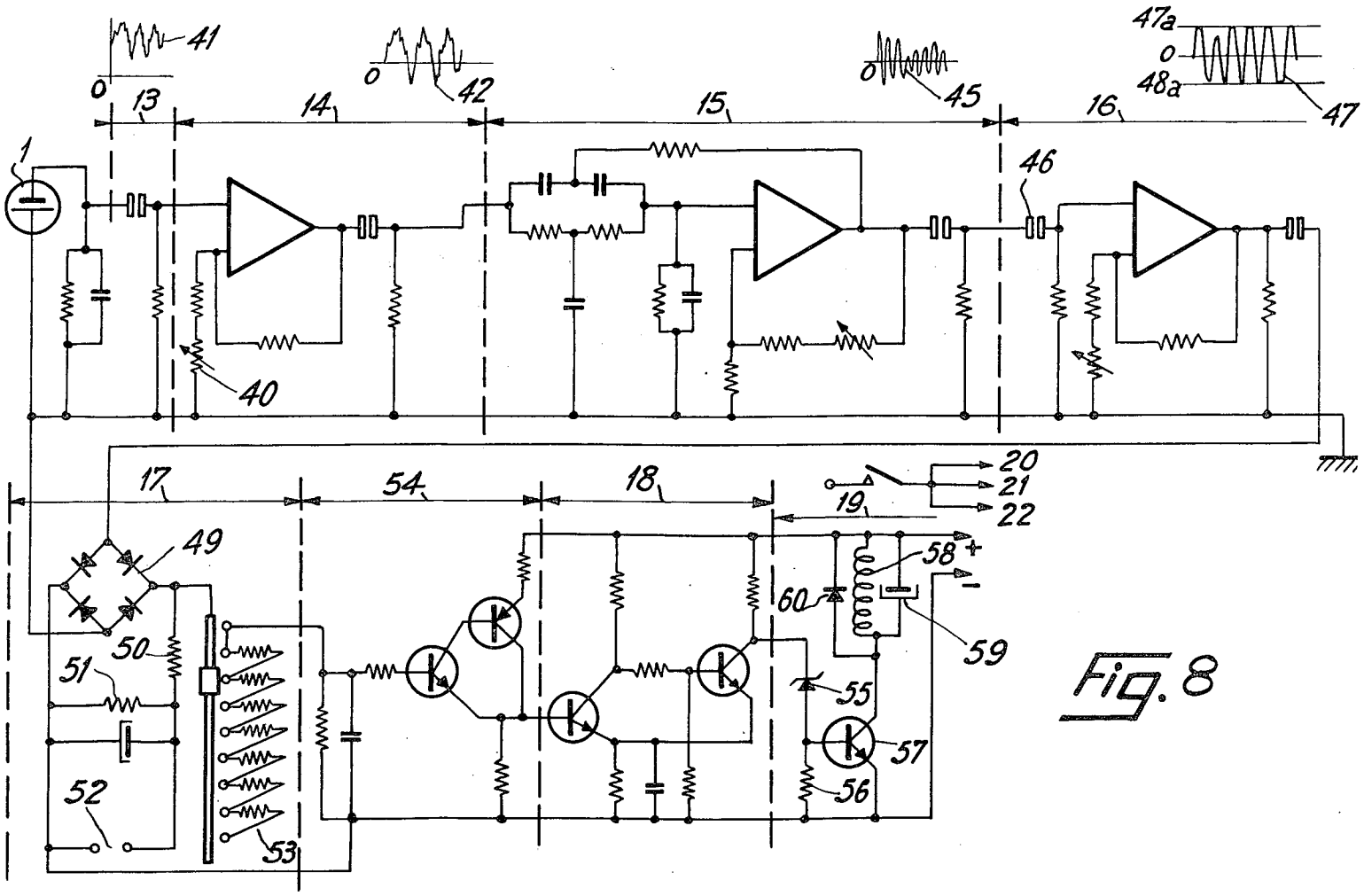

FIG. 3 is a cross-section of a flame sighting tube associated with a photo-voltaic cell, FIG. 4 is a diagram showing, as a function of the frequency, the cut-off effect on a complex frequency signal of a high-pass filter, FIG. 5 is a block schematic diagram of a flame-monitoring apparatus embodying the invention, FIG. 6 is a cross-section of the front of a boiler comprising twelve high-power burners, FIG. 7 is a cross-section along the line VII—VII of FIG. 6, FIG. 8 is the complete circuit diagram of the flame monitoring apparatus.

It is possible to determine theoretically and experimentally the distribution of the energy $E(f)$, as a function of the frequency expressed in Hertz, in the physical phenomena and especially in the radiated energy appearing in the turbulent efflux of a high-power blast burner for combustible liquids, for example.

When a burner is in normal use, i.e. alight in a hot enclosure, this distribution of energy corresponds to the curve $K_1$. As soon as the burner is extinguished, the enclosure remaining hot and the surroundings luminous, the distribution of energy corresponds to the curve $K_2$. This second curve $K_2$ drops to zero below 50 Hz. In contrast thereto, the curve $K_1$ becomes close to zero only beyond 200 Hz, and for the frequencies 50 to 100 Hz corresponds to a relatively large energy.

Although all the physical phenomena downstream from the burner undergo pulsations owing to the turbulent efflux, the present arrangement is particularly advantageous in which a photo-electric pick-up is selected to display them, which avoids the necessity of immersing the pick-up in the flame.

There is used here for this purpose a silicon photovoltaic cell comprising a p-n junction. Such a cell, is sold for example by the Société Radiotechnique-Compelec (R.T.C) under the reference BPX46.

Figure 1:
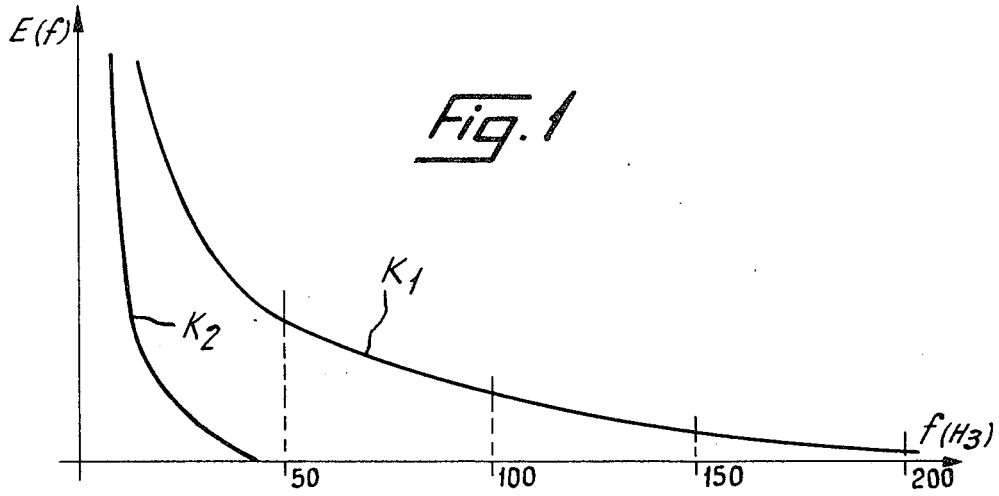
FIG. 1 is a schematic diagram of the distribution of spectral energy in the turbulent efflux at the output of a blast burner.
Figure 2:
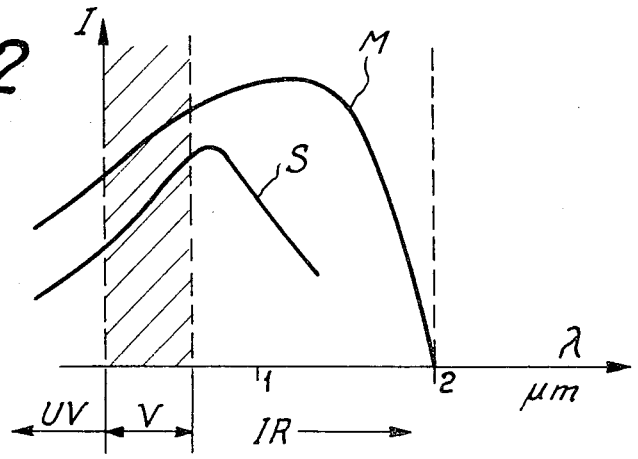
FIG. 2 is a diagram showing the emission spectrum of a burner flame and the response curve of a silicon photo-voltaic cell.

FIG. 2 shows by way of example the response curve M of such a cell compared with the spectral curve S of a blast flame of fuel-oil. In the diagram the region V of the wavelengths $\lambda$ (in $\mu$m) which correspond to the visible light, have been shaded, and the infra-red and ultra-violet regions have been indicated by IR and UV respectively.

Such a cell is in a position to detect virtually all the radiation emitted by a burner flame, and even when this flame is extinguished there will continue to be emitted considerable energy as a result of the infra-red emission of the enclosure and possibly that of adjacent burners.

The assembly of the cell is effected as shown in FIG. 3.

The cell is in the form of a disc 1 and the disc is mounted in a cylindrical casing 2 formed by superposed elements 4, 5, 6 joined by screws 7. The cell is protected by a heat shield 8 stopping, at least in part, the infra-red rays of great wave length.

By means of the thread 10, the casing 2 is mounted either on the enclosure or on the end of a flame sighting tube as described with respect to FIGS. 6 and 7.

As a result of the area of the cell (diameter approximately 40 mm for a BPX46 cell), observation does not present any difficulties.

By means of the connector 11, the conductors 12 of the cell are connected to signal processing circuitry.

The signal of the cell 1 comprises a continuous component which (FIG. 5) is eliminated by a capacitive filter 13. Thus only the alternating component of the signal enters an operational amplifier 14 which raises, for example, a peak to peak signal of 100 mV to a level of 10 volts.

The amplified signal enters into a high-pass filter 15 which effectively eliminates low-frequency components below 50 Hz.

This filter is an active so-called "elliptical" filter for obtaining a virtually maximum slope at the cut-off frequency level. An example of such a filter is shown further on.

The response curve of the filter is shown in FIG. 4.

The cut-off is practically total as far as A, i.e. until the frequency of approximately 25 Hz. Conversely, the signal frequencies pass freely from B, i.e. from 50 Hz; the attenuation is approximately 30 db per octave. The output of the filter 15, is connected to an amplifier 16, at the output of which there is picked up, in the case of an active flame, a large signal, for example of the order of 10 volts, with the frequencies of 50 to 100 Hz and if the flame is extinguished, a zero signal.

The output of the amplifier 16 is connected to a detector-integrator 17 which develops a practically constant continuous voltage, which is thus, in the presence of a flame, from 5 to 10 volts, for example, and practically nil in the absence of a flame.

This output voltage of the integrator controls a trigger assembly 18 which in turn controls, by a relay 19, a sound signal 20, a light signal 21 and by the path 22, an automatic checking and controlling device of the burner. It is, of course, possible to employ only one or two out of three of the devices 20, 21, 22, and the latter would be the one usually employed.

The monitoring of each of the flames of a plurality of burners arranged in parallel in the same thermal high power combustion chamber will now be described.

The boiler front shown in FIGS. 6 and 7 comprises three superposed enclosures supplied with air by a blower not shown.

Each of these enclosures carries four burners 34, each joined to a fixing disc 35 which likewise supports a sighting tube comprising a rectilinear tube 36 to the outside end of which is attached the casing 2 carrying the photo-voltaic cell 1.

The sighting tube 36 opens into the bottom of the container near the extremity of the burner 34, behind apertures 38 for the inlet of secondary air to the burner.

This arrangement has the advantage of clearing the atmosphere in the region of the sighting tube and retarding the contamination of the cell by soot.

Furthermore, the axis of the sighting tube forms a very small angle, less than 10°, with the axis of the burner. Finally, the sighting tube of each burner is arranged in a radial plane P which in the case in question forms the angle $\alpha$ with the vertical direction, this plane being chosen so that the axis of the sighting tube does not meet any other burner axis than that whose flame it surveys.

Thus the sighting tube overlooks substantially the heart of the flame with which it is associated and the base of the combustion chamber through the hot gases (which belong to the other burners) the turbulence of which is already partly calmed.

Thus, when the associated flame is alight, the cell receives a luminous beam bearing the flicker, the frequency of which is relatively high, whilst when the flame is extinguished the variations in illumination of the bottom of the chamber by the group of burners still alight and the radiation of the flame extremities of these burners produces only relatively low frequencies (less than 50 Hz).

FIG. 8 illustrates a circuit diagram corresponding to FIG. 5 for the processing of the output signal of each of the cells 1.

A potentiometer 40 in the amplifier 14 permits the regulation of the sensitivity of the cell 1.

Thus, a signal 41, modulated but with a strong continuous component leaves the cell and is transmitted, owing to the capacitor 13, without its d.c. component to the amplifier 14 from which there leaves a signal 42 comprising only the amplified alternating components which are exclusively transmitted to the filter 15.

The elliptic filter 15, as described in the article entitled "Design active elliptic filters easily" of the review "ELECTRONIC DESIGN," 21st October 1971, is designed to stop practically completely the frequencies lower than 25 Hz and allows to pass freely frequencies above 50 Hz as shown in FIG. 4. This filter is a third order filter and has three poles and two zeros.

From the filter 15 there leaves a signal 45 which no longer has any frequencies below 50 Hz and which is transmitted by a capacitor 46 to the amplifying stage 16. The latter is arranged to saturate so as to supply a signal 47 of which the peaks 48*a* and 48*b* have the maximum output amplitude from this amplifier which levels the signal directed to the detector and fixes in practice the value of the rectified signal.

The detector integrator 17 comprises a rectifier 49 of the bridge type which charges an integration circuit 50, the capacitor of which is shunted by a high resistance 51 designed to permit the discharge at the time of the extinction of the burner. Terminals 52 enable the measurement of the flame signal.

A tapped rheostat 53 allowing an adjustable attenuation, permits the signal of the detector integrator to be applied to an amplifier 54 with unitary gain for the purpose of adapting the impedance of the signal to that of the Schmitt trigger 18 comprising two transistors having their emitters commoned.

The output level of this trigger is controlled by a Zener diode 55 in series with a resistance 56. Thus when the output voltage of the trigger exceeds the level defined by the assembly 55, 56, this output voltage is applied to an amplifier 57 for supplying a winding 58 of a control relay of an alarm device.

Finally, to avoid unwarranted transient operation, the excitation of the winding 58 is delayed by a capacitor 59 and, when the excitation of the relay stops, the inductively stored energy in its winding is dissipated in a diode 60.

We claim:

1. Flame monitoring apparatus comprising:

wide frequency band photo-electric pick-up means to receive luminous radiation from a flame being monitored, amplifying means coupled to the output of the photo-electric pick-up means, and an output circuit responsive to the output of the amplifying means to provide an indication of whether or not the flame is alight, wherein the improvement consists of connecting in the amplifying means a high-pass filter having a cut-off frequency of the order of 50 Hertz to prevent signals below the cut-off frequency reaching the output circuit.

2. Flame monitoring apparatus comprising:

wide frequency band photo-electric pick-up means, amplifier means, capacitive coupling means connected from the output of said photo-electric pick-up means to the input of said amplifier means, rectifier means connected to the output of said amplifier means, and monitoring means connected to the output of said rectifier means and responsive to current therefrom to indicate that the flame is alight, wherein the improvement consists of connecting in the circuit of the apparatus high-pass filter means having a cut-off frequency of the order of 50 Hertz.

3. Apparatus as set forth in claim 2, wherein said filter is an elliptical filter.

4. Apparatus as set forth in claim 2, wherein the output of said high-pass filter means is connected to amplifying means, the output of said amplifying means is connected to detector integrator means, and the output of said detector means is connector to trigger means, the output of said trigger means being connected to said monitoring means.

5. Heating apparatus comprising:

combustion chamber means, a plurality of burner means mounted parallel to each other in said combustion chamber means, and flame monitoring apparatus as set forth in claim 1, wherein each of said burner means is provided with sighting tube means, one end of each sighting tube means mounts a respective photo-electric pick-up means, the other end of each sighting tube means is close to the output of its associated burner means and the axis of the said sighting tube forms a small angle with the axis of its associated burner means so as to meet said axis in the region where the flame has a maximum intensity.

6. Heating apparatus as set forth in claim 5, wherein each plane containing the axis of a burner means and the axis of its associated sighting tube means is distinct from planes containing the axes of the other burner means.

7. Heating apparatus as set forth in claim 5, wherein the sighting tube means of each burner means opens into the combustion chamber means behind the orifice of the burner means and behind inlet means for secondary air for said burner means.

8. Flame monitoring apparatus comprising:

wide frequency band photo-electric pick-up means, capacitive coupling means having its input connected to the output of said pick-up means, first amplifying means having its input connected to the output of the capacitive coupling means, high-pass filter means having a cut-off frequency of about 50Hz having its input connected to the output of said first amplifying means, second amplifying means adapted to saturate and having its input connected to the output of said high-pass filter means, detector integrator means having its input connected to the output of said second amplifying means, trigger means having its input connected to the output of said detector integrator means, and output circuit means having its input connected to the output of said trigger means and adapted to provide an output signal if the flame being monitored is extinguished.

9. In a heating apparatus comprising a combustion chamber and a plurality of burners mounted parallel to each other in said combustion chamber the provision of a flame monitoring apparatus comprising:

a. A same plurality of sighting tubes, respectively associated to said burners, the axis of each sighting tube forming a small angle with the axis of its associated burner so as to meet said axis in the region where the burner flame has a maximum intensity, and the one end of each sighting tube being close to the output of its associated burner;

b. the same plurality of wide frequency band photoelectric pick-up means mounted to the other ends of said sighting tubes, respectively;

c. amplifying means coupled to the output of said photoelectric pick-up means, respectively;

d. a same plurality of output circuits responsive to the outputs of said amplifying means to provide indications of whether or not the respective flames of the associated burners are alight, and e. filter means connected to said amplifying means, said filter means having a cut-off frequency of the order of 50 Hertz to prevent signals below the cut-off frequency reaching said output circuits.

10. Heating apparatus as set forth in claim 9, wherein each plane containing the axis of a burner means and the axis of its associated sighting tube means is distant from planes containing the axes of the other burner means.

11. Heating apparatus as set forth in claim 9, wherein the sighting tube means of each burner means opens into the combustion chamber means behind the orifice of the burner means and behind inlet means for secondary air for said burner means.

* * * * *